US011254151B2

(12) United States Patent
Nagai et al.

(10) Patent No.: US 11,254,151 B2
(45) Date of Patent: Feb. 22, 2022

(54) RECORDING APPARATUS

(71) Applicant: SEIKO EPSON CORPORATION, Tokyo (JP)

(72) Inventors: Yoshikazu Nagai, Shiojiri (JP); Yoshiyuki Okazawa, Shiojiri (JP); Kazunori Takabayashi, Okaya (JP); Hisayuki Akahane, Matsumoto (JP); Kensuke Tamai, Shiojiri (JP); Shintaro Miyamoto, Shiojiri (JP); Katsumi Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/878,151

(22) Filed: May 19, 2020

(65) Prior Publication Data

US 2020/0369055 A1 Nov. 26, 2020

(30) Foreign Application Priority Data

May 22, 2019 (JP) ..... JP2019-095798

(51) Int. Cl.
*B41J 29/13* (2006.01)
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS

| | | | | |
|---|---|---|---|---|
| 6,338,539 | B1 | 1/2002 | Kobayashi et al. | |
| 2013/0188001 | A1 | 7/2013 | Kimura et al. | |
| 2013/0255989 | A1* | 10/2013 | Ito | G03G 21/1652 174/60 |
| 2017/0217194 | A1* | 8/2017 | Okawa | B41J 2/175 |
| 2018/0034989 | A1* | 2/2018 | Fujibayashi | G03G 21/1633 |
| 2018/0097948 | A1 | 4/2018 | Namba | |
| 2018/0178567 | A1* | 6/2018 | Takabayashi | B41J 2/17513 |
| 2018/0272731 | A1 | 9/2018 | Kimura et al. | |
| 2019/0105903 | A1* | 4/2019 | Kimura | B41J 2/16538 |

FOREIGN PATENT DOCUMENTS

| | | |
|---|---|---|
| EP | 844094 | 5/1998 |
| JP | 2018-052003 | 4/2018 |
| JP | 2018-161851 | 10/2018 |

* cited by examiner

*Primary Examiner* — Erica S Lin
*Assistant Examiner* — Tracey M McMillion
(74) *Attorney, Agent, or Firm* — Workman Nydegger

(57) ABSTRACT

A recording apparatus includes a recording head, an ink tank that is disposed above the recording head, a carriage on which the recording head and the ink tank are mounted, a scanner unit that is attached to the upper portion of the casing via a pivot shaft so as to pivot with respect to the casing and that reads a document placed on the document table, and a panel unit in which the scanner unit is attached to an end portion disposed on the opposite side to the pivot shaft and is configured to tilt between a first orientation and a second orientation closer to the document table than the first orientation, and by pivoting the scanner unit with respect to the casing to expose the ink tank, ink is injected from the refill container into the ink tank and the remaining amount of liquid is viewed.

10 Claims, 10 Drawing Sheets

RECORDING APPARATUS

The present application is based on, and claims priority from JP Application Serial Number 2019-095798, filed May 22, 2019, the disclosure of which is hereby incorporated by reference herein in its entirety.

BACKGROUND

1. Technical Field

The present disclosure relates to a recording apparatus.

2. Related Art

For example, there has been proposed a recording apparatus in which a recording head and an ink tank are mounted on a carriage, and an amount of ink remaining in the ink tank can be easily checked from outside the apparatus.

The printing apparatus described in JP-A-2018-161851 includes a casing having a carriage in which a print head and an ink tank are mounted, and an upper portion cover that opens and closes an upper portion of the casing. Furthermore, an operation panel and a viewing portion that enables checking of the remaining amount of ink in the ink tank are provided on a front-surface-side casing portion of the casing.

However, in the recording apparatus described in JP-A-2018-161851, since the operation panel and the viewing portion are provided on a front-surface-side casing side wall portion of the casing, if the viewing portion is increased in size to enable easy checking of the remaining amount of ink in the ink tank from outside the apparatus, there has been a problem that the operation panel becomes relatively small and difficult to use, and user convenience is reduced.

SUMMARY

According to an aspect of the disclosure, a recording apparatus includes a recording portion that performs recording by ejecting a liquid onto a medium; a liquid housing portion that is disposed above the recording portion, that houses the liquid to be supplied to the recording portion, and that has an injection port through which the liquid is injected from a refill container; a carriage on which the recording portion and the liquid housing portion are mounted, and which is configured to move in a width direction intersecting a direction in which the medium is transported; a casing having the carriage therein, a scanner unit that is attached to the casing via a pivot shaft at an upper portion of the casing so as to pivot and that reads a document placed on a document table, and a panel unit through which various operations are performed, in which the panel unit is attached to an end portion of the scanner unit opposite to the pivot shaft and is configured to tilt between a first orientation and a second orientation closer to the document table than to the first orientation, and by pivoting the scanner unit with respect to the casing and opening the scanner unit by a fixed amount, the liquid is injected from the refill container into the liquid housing portion and a remaining amount of the liquid is viewed.

In the recording apparatus, the carriage and the casing may include a viewing portion that allows a user to view the remaining amount of the liquid housed in the liquid housing portion.

In the recording apparatus, the casing may include a front-surface-side casing side wall portion that is disposed so as to face the panel unit in the first orientation, and the viewing portion may be provided on the front-surface-side casing side wall portion.

In the recording apparatus, when the scanner unit is opened, in a plan view viewed from a direction toward the pivot shaft from the front-surface-side casing side wall portion, the viewing portion may not overlap with the panel unit and the end portion.

In the recording apparatus, the injection port may be disposed outside the scanner unit.

In the recording apparatus, the panel unit is configured to be operated both in the case where the scanner unit is opened with respect to the casing so that the liquid is injected from the refill container into the liquid housing portion and in the case where the scanner unit is closed with respect to the casing to cover the liquid housing portion.

The recording apparatus may further include a lock portion that restricts movement of the scanner unit in a state in which the scanner unit is closed with respect to the casing so as to cover the liquid housing portion.

In the recording apparatus, the lock portion may change a lock release load that releases a locked state that restricts movement of the scanner unit in accordance with an angle of the panel unit with respect to the document table.

DESCRIPTION OF EXEMPLARY EMBODIMENTS

Figure 1:
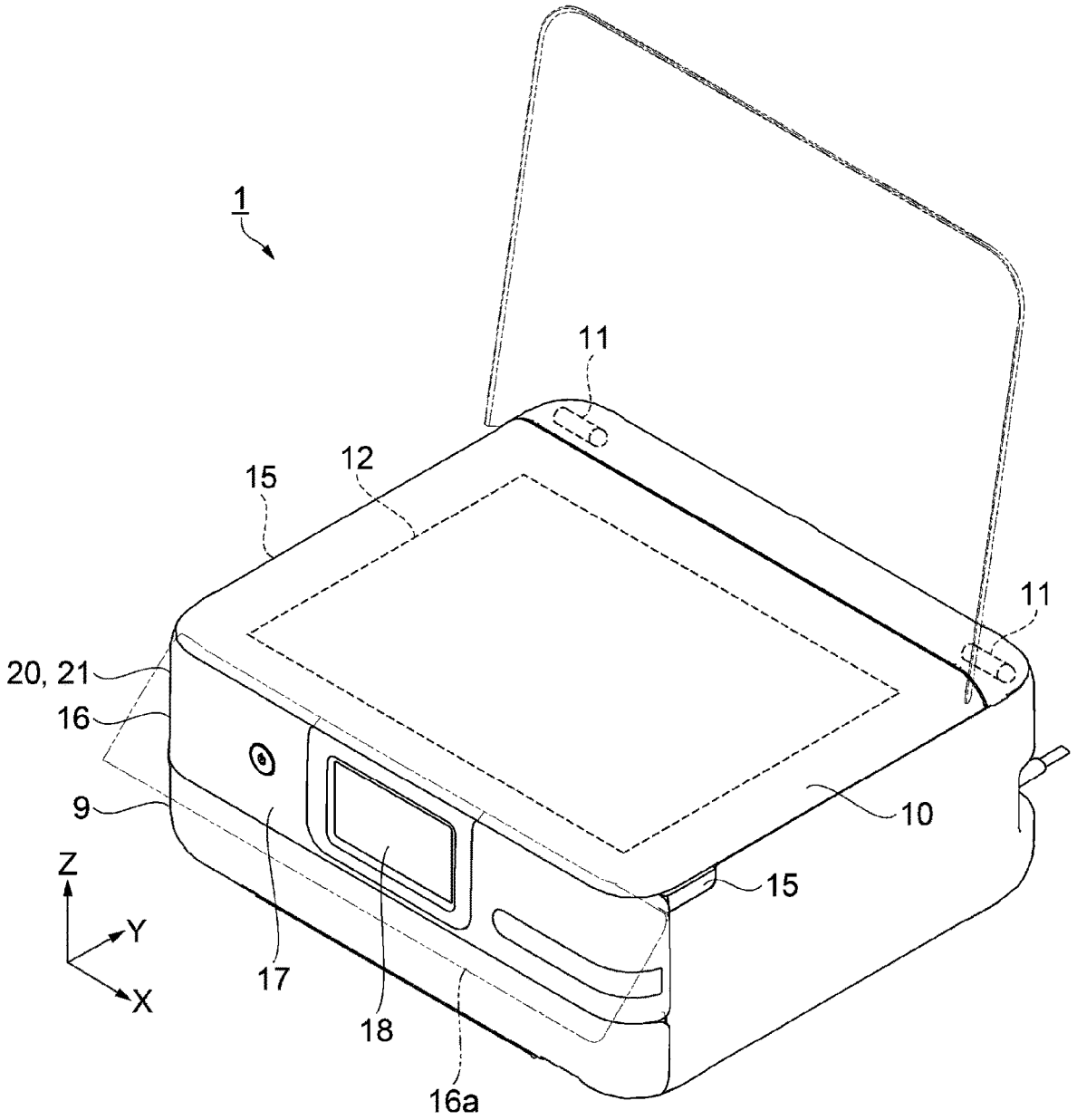
FIG. 1 is a perspective view of a recording apparatus according to a first embodiment.

Hereinafter, embodiments of the disclosure will be described with reference to the drawings. Such an embodiment illustrates one aspect of the present disclosure, and does not limit the present disclosure, and can be arbitrarily changed within the technical idea of the present disclosure. In addition, in the following drawings, the scale of each layer and each portion is different from the actual scale in order to make each layer and each portion sufficiently large to be recognized in the drawings.

First Embodiment

Figure 2:
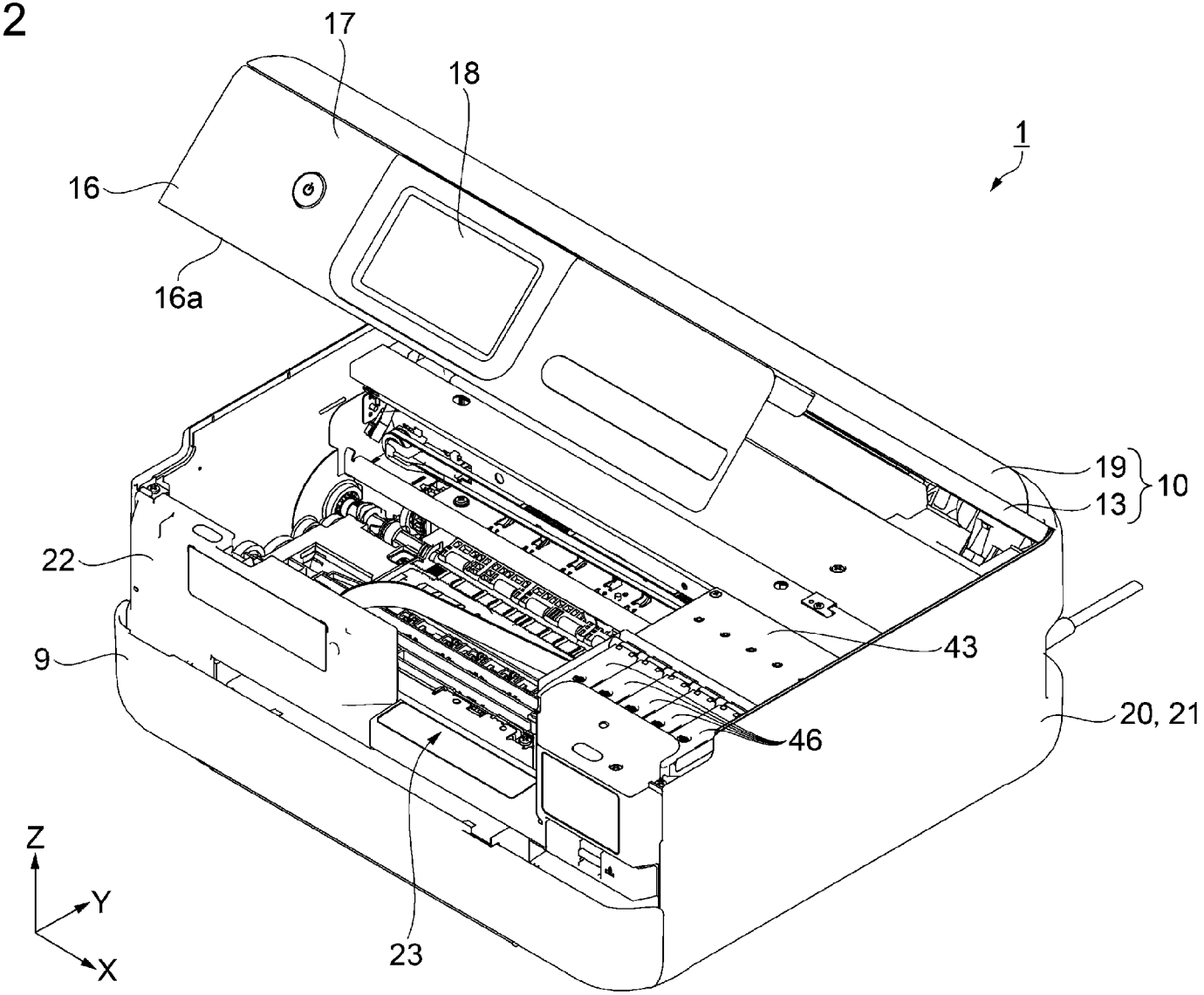
FIG. 2 is another perspective view of the recording apparatus according to the first embodiment.
Figure 3:
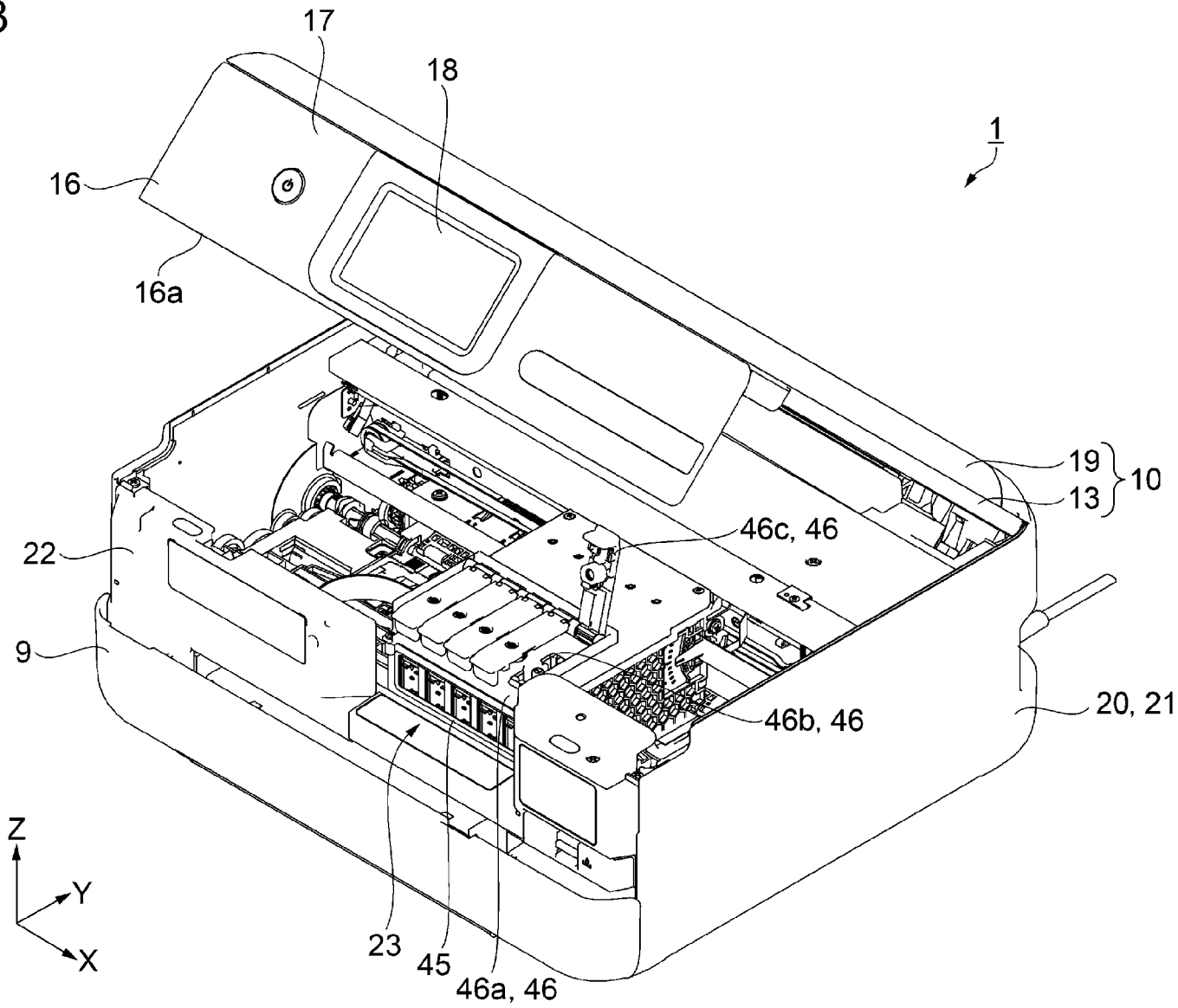
FIG. 3 is another perspective view of the recording apparatus according to the first embodiment.
Figure 4:
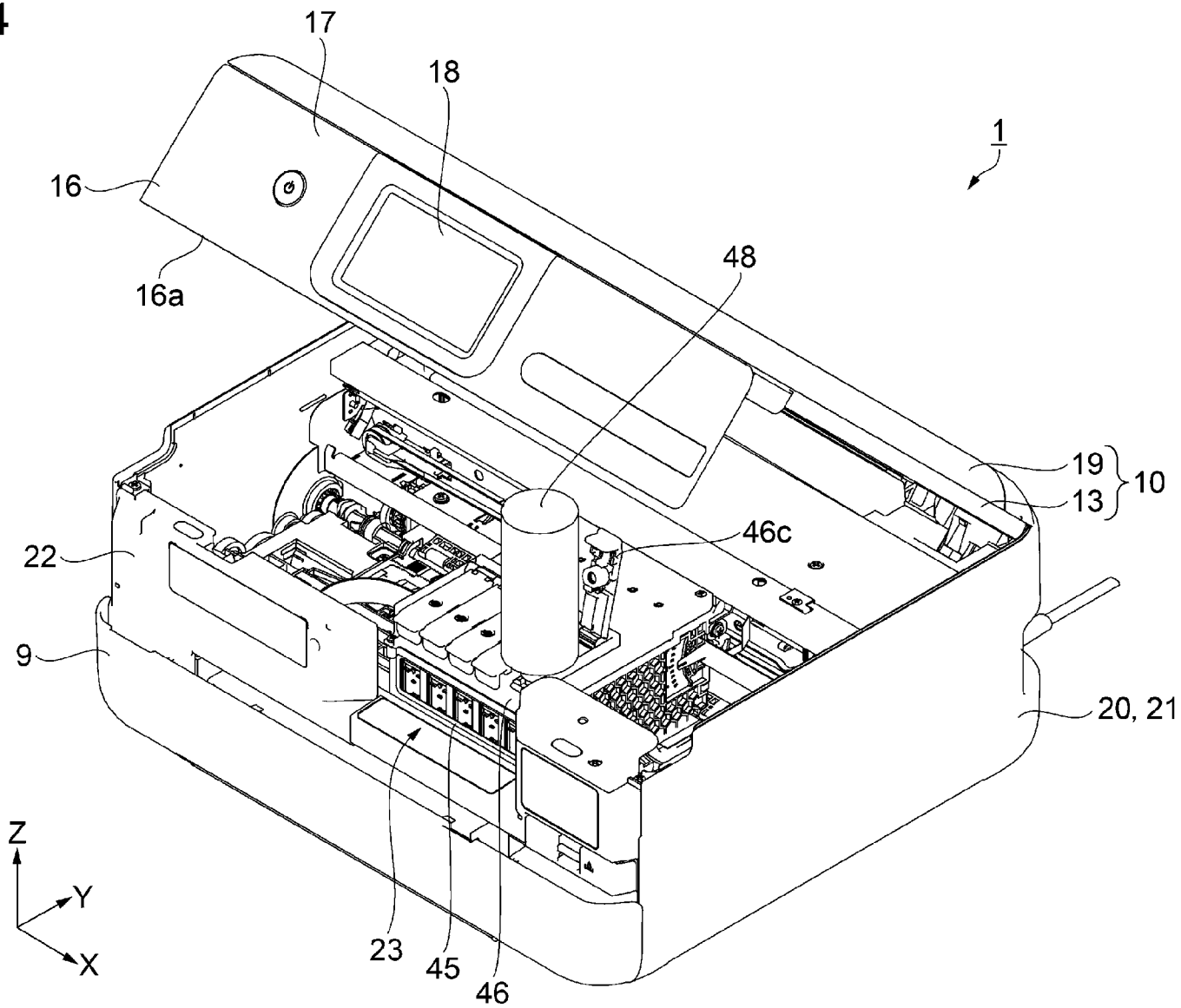
FIG. 4 is another perspective view of the recording apparatus according to the first embodiment.
Figure 5:
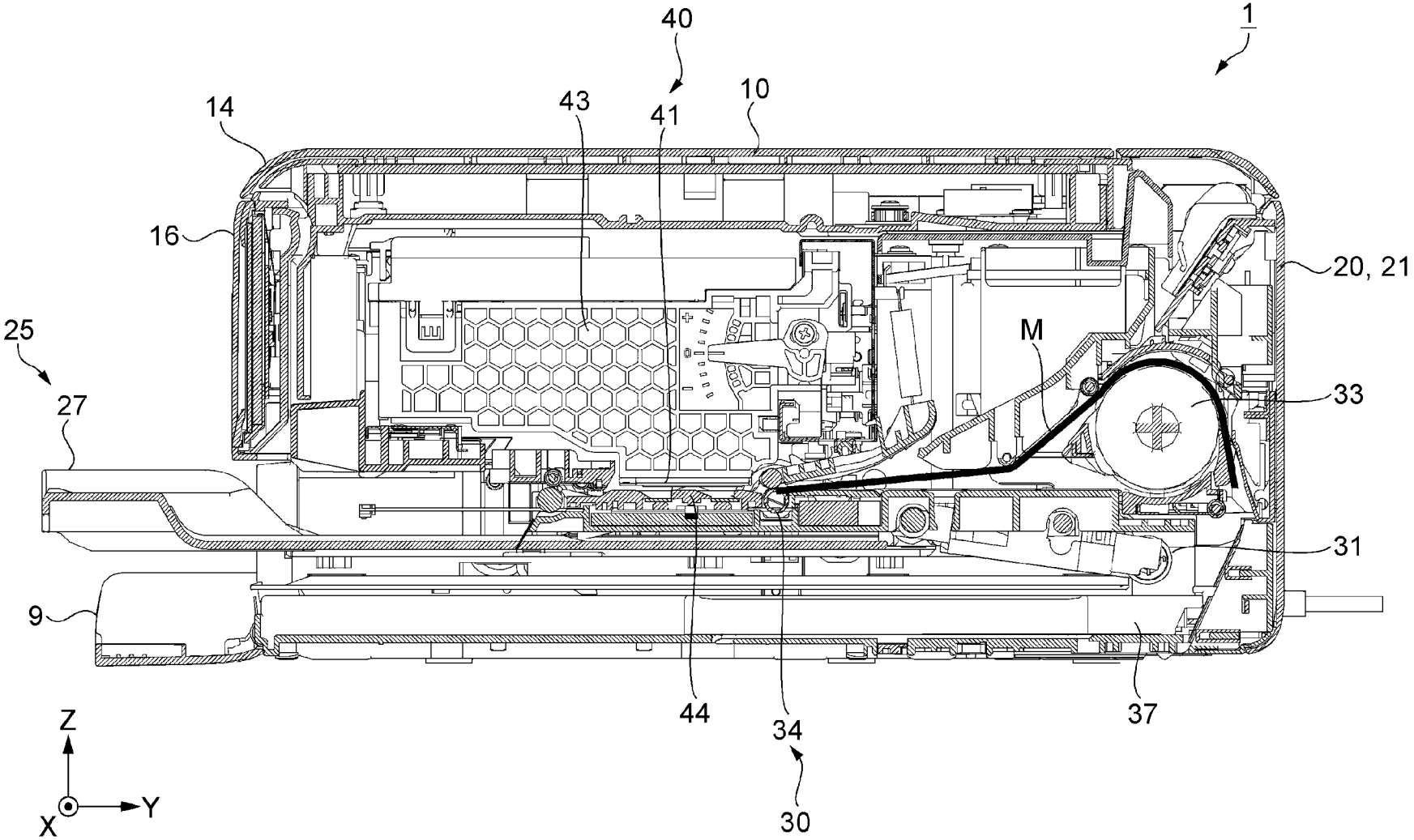
FIG. 5 is a side sectional view of the recording apparatus according to the first embodiment.
Figure 6:
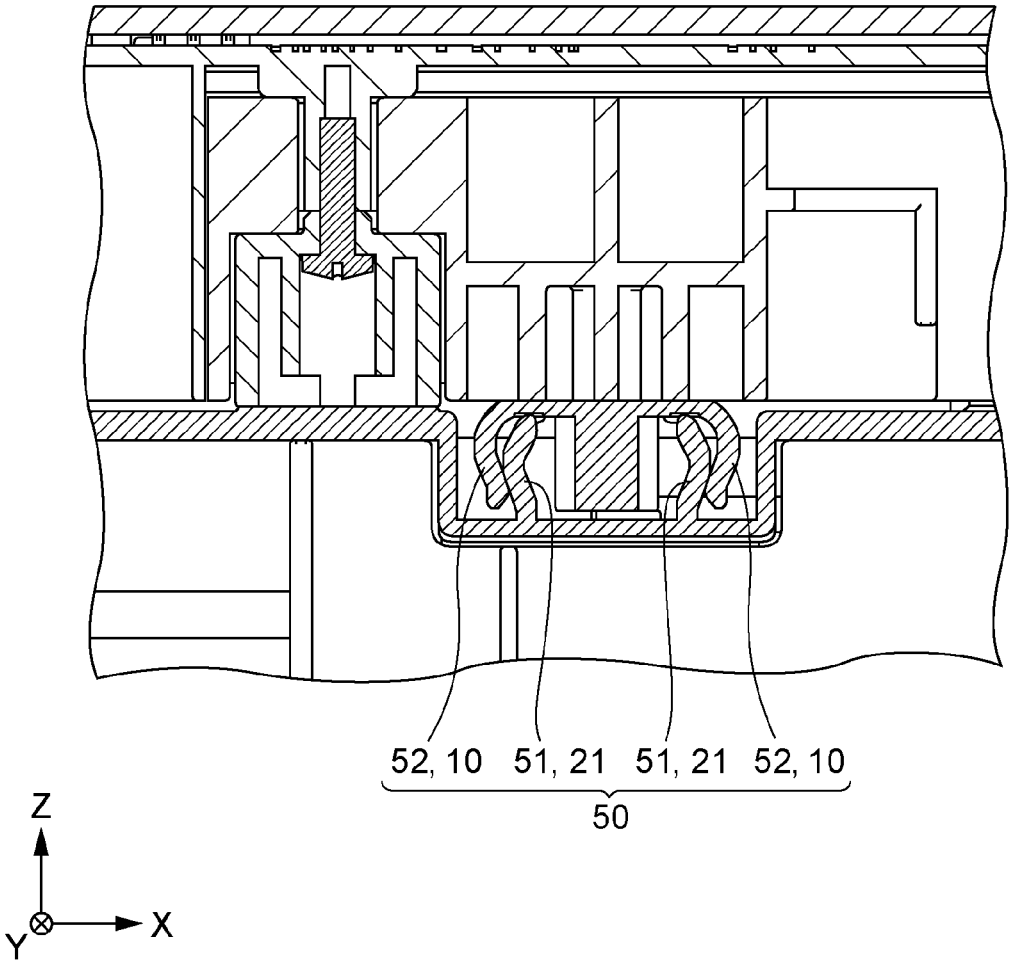
FIG. 6 is a sectional view of a main portion of a lock portion.

FIG. 1 is a perspective view of a recording apparatus 1 according to a first embodiment. FIGS. 2 to 4 are other perspective views of the recording apparatus 1 according to the present embodiment. FIG. 5 is a side sectional view of the recording apparatus 1 according to the present embodiment. FIG. 6 is a sectional view of a main portion of a lock portion 50.

FIG. 1 illustrates a state in which a scanner unit 10 is closed with respect to a casing 21. FIGS. 2 to 4 illustrate a state in which the scanner unit 10 is opened with respect to the casing 21. Furthermore, FIG. 2 illustrates a state in which a carriage 43 is disposed at a home position, and FIGS. 3 and 4 illustrate a state in which the carriage 43 is disposed at a position where ink can be injected into ink tanks 46 (hereinafter, referred to as an ink injection position).

In addition, in the following description, the state in which the scanner unit 10 is opened with respect to the casing 21 is referred to as the scanner unit 10 being in an open state, and the state in which the scanner unit 10 is closed with respect to the casing 21 is referred to as the scanner unit 10 being in a closed state.

Hereinafter, an outline of the recording apparatus 1 according to the present embodiment will be described with reference to FIGS. 1 to 6.

As illustrated in FIG. 1, the recording apparatus 1 includes an apparatus main body 20 (the casing 21), which has a rectangular parallelepiped shape, and the scanner unit 10 attached to an upper portion thereof, and is installed on a horizontal plane. Furthermore, the recording apparatus 1 has a panel unit 16 attached to an end portion 14 of the scanner unit 10 (refer to FIG. 5), and a control portion (not illustrated).

The control portion is disposed inside the apparatus main body 20, has a CPU, a memory, and the like, and controls each portion of the recording apparatus 1.

In the following description, the longitudinal direction (width direction) of the apparatus main body 20 having a rectangular parallelepiped shape is defined as an X direction, the short direction (depth direction) of the apparatus main body 20 is defined as a Y direction, and the height direction of the apparatus main body 20 is defined as a Z direction. In addition, the distal end of an arrow indicating a direction is defined as a +direction, and the base end of an arrow indicating a direction is defined as a −direction.

Further, the Y direction is an example of a direction from the front-surface-side casing side wall portion of the present application toward the pivot shaft.

The scanner unit 10 is disposed above the casing 21 of the apparatus main body 20 and is attached to the casing 21 of the apparatus main body 20 so as to pivot via a pivot shaft 11 indicated by a broken line in the figure. As a result, the scanner unit 10 pivots about the pivot shaft 11 as a pivot center. The casing 21 is an outer case of the apparatus main body 20, and has the ink tanks 46 (refer to FIG. 2) therein. In the scanner unit 10, a scanner housing portion 13 (refer to FIG. 2) that reads a document placed on a document table 12 indicated by a broken line in the figure, the document table 12 on which a document is placed, and an upper lid 19 are sequentially disposed along the Z direction.

In the scanner unit 10, the upper lid 19 is provided on the document table 12. The upper lid 19, as indicated by a solid line and a two-dot chain line in the figure, can be opened and closed with respect to the document table 12 indicated by a broken line in the figure. When the upper lid 19 is opened, the document table 12 is exposed, and a document can be set on the document table 12. The document table 12 is disposed parallel to a horizontal plane, and is made of a transparent and flat glass plate. The scanner housing portion 13 is configured to read images such as characters and photographs recorded on a document placed on the document table 12.

The pivot shaft 11 indicated by a broken line in the figure is disposed on the +Y direction side of the casing 21 and supports the scanner unit 10 so as to pivot with respect to the casing 21. An end on the −Y direction side of the scanner unit 10 is the end portion 14 of the scanner unit 10. The end portion 14 of the scanner unit 10 is disposed on the opposite side to the pivot shaft 11.

In the scanner unit 10, a pair of handle portions 15 are provided on side surfaces (a surface on the +X direction side and a surface on the −X direction side). The user can open and close the scanner unit 10 with respect to the casing 21 by holding the handle portions 15.

The panel unit 16 is attached to the end portion 14 of the scanner unit 10. The panel unit 16 pivots together with the scanner unit 10 about the pivot shaft 11 as a pivot center.

Furthermore, the panel unit 16 can be tilted with respect to the scanner unit 10 as illustrated by a solid line and a two-dot chain line in the figure. In addition, when the panel unit 16 is tilted with respect to the scanner unit 10, the end on the −Y direction side of the panel unit 16 is a distal end 16*a*.

In FIG. 1, a solid line indicates the panel unit 16 that forms an angle of 90 degrees with the document table 12, that is, the panel unit 16 that forms an angle of 90 degrees with the horizontal plane. The orientation of the panel unit 16 at an angle of about 90 degrees with the document table 12 illustrated by a solid line in FIG. 1 is an example of a first orientation, and is hereinafter referred to as a first orientation. The orientation of the panel unit 16 shown by a two-dot chain line in FIG. 1 is an example of a second orientation closer to the document table than the first orientation in the present application, and is hereinafter referred to as a second orientation.

Furthermore, when the orientation of the panel unit 16 is the first orientation, the panel unit 16 is referred to as being in the closed state, and when the orientation of the panel unit 16 is the second orientation, the panel unit 16 is referred to as being in the open state.

In addition, the panel unit 16 can be tilted from a state perpendicular to the document table 12 to a state parallel to the document table 12. The first orientation is an orientation of the panel unit 16 perpendicular to the document table 12. The second orientation is an orientation of the panel unit 16 that is not perpendicular to the document table 12.

Thus, the recording apparatus 1 according to the present embodiment includes the panel unit 16 that is attached to the end portion 14 of the scanner unit 10 that is located on the opposite side to the pivot shaft 11 and that is capable of tilting between the first orientation and the second orientation, which is closer to the document table 12 than the first orientation.

A front door 9 is provided at a lower portion (−Z direction side) of the apparatus main body 20. The front door 9 can be opened and closed, and when the front door 9 is open, a discharge portion 25 is exposed. Specifically, as illustrated in FIG. 5, the front door 9 is open, and a discharge plate 27 housed in the apparatus main body 20 is made to protrude toward the −Y direction to form the discharge portion 25. Then, the medium on which the image is recorded is discharged to the discharge portion 25.

As illustrated in FIGS. 2 and 3, when the scanner unit 10 is open, a front-surface-side casing side wall portion 22 of the casing 21 of the apparatus main body 20 is exposed. Further, when the scanner unit 10 is in the closed state and the panel unit 16 is in the first orientation, the front-surface-side casing side wall portion 22 of the casing 21 is disposed to face the panel unit 16. In other words, the casing 21 has the front-surface-side casing side wall portion 22 that is disposed to face the panel unit 16 in the first orientation.

The front-surface-side casing side wall portion 22 of the casing 21 is disposed on the opposite side to the pivot shaft 11, and the direction from the front-surface-side casing side wall portion 22 to the pivot shaft 11 is the Y direction. The view in the direction from the front-surface-side casing side wall portion 22 toward the pivot shaft 11 corresponds to a plan view seen from the direction from the front-surface-side casing side wall portion toward the pivot shaft in the present application, and is hereinafter simply referred to as a plan view.

Furthermore, when the scanner unit 10 and the panel unit 16 are pivoted about the pivot shaft 11 as a pivot center and opened with respect to the casing 21, the carriage 43 and the ink tanks 46 disposed inside the apparatus main body 20 are exposed. Furthermore, as will be described later in detail, when the scanner unit 10 and the panel unit 16 are pivoted about the pivot shaft 11 and opened with respect to the casing 21, the user can view the remaining ink amount in the ink tanks 46, and can fill the ink tanks 46 with ink.

The panel unit 16 has a main body 17 and an operation panel 18. The operation panel 18 is formed of a liquid crystal display device having a touch panel. The user can make various settings for the recording apparatus 1 using the operation panel 18.

In the present embodiment, in both a state in which the scanner unit 10 is open with respect to the casing 21 (open state) and a state in which the scanner unit 10 is closed with respect to the casing 21 (closed state), the panel unit 16 can be operated, and various settings can be performed on the recording apparatus 1 by using the operation panel 18. That is, it is possible to operate the panel unit 16 in both the open state and the closed state of the scanner unit 10. When the panel unit 16 is operable in both the open state and the closed state of the scanner unit 10, compared with the case where the panel unit 16 is operable in either the open state or the closed state of the scanner unit 10, user convenience is improved.

Furthermore, regardless of whether the orientation of the panel unit 16 is the first orientation or the second orientation, the panel unit 16 can be operated.

A cutout 23 is formed in the vicinity of the center of the front-surface-side casing side wall portion 22 of the casing 21, and the lock portion 50 is formed on the −X direction side of the cutout 23. The lock portion 50 is provided at a portion where the scanner unit 10 and the casing 21 are in contact with each other when the scanner unit 10 is in the closed state.

As illustrated in FIG. 6, the lock portion 50 has a locking claw 51 protruding in the +Z direction and a locking claw 52 protruding in the −Z direction. The locking claw 51 is provided on the casing 21, and the locking claw 52 is provided on the scanner unit 10.

When the scanner unit 10 is in the closed state, the locking claw 51 protruding in the +Z direction and the locking claw 52 protruding in the −Z direction are locked, the scanner unit 10 is locked with respect to the casing 21, and the movement of the scanner unit 10 in the X direction with respect to the casing 21 is restricted. The provision of the lock portion 50 makes it difficult for the scanner unit 10 to be mechanically damaged. In addition, the user can easily release the locked state of the lock portion 50 and open the scanner unit 10.

Thus, the recording apparatus 1 according to the present embodiment has the lock portion 50 that restricts movement when the scanner unit 10 is closed with respect to the casing 21 so as to cover the ink tanks 46 (when the scanner unit 10 is closed).

In addition, the force for releasing the locked state of the lock portion 50 is the lock release load. In the present embodiment, the lock release load for releasing the locked state of the lock portion 50 does not change depending on the angle of the panel unit 16 with respect to the document table 12, and remains the same.

Returning to FIGS. 2 and 3, the carriage 43, a recording head 41 (refer to FIG. 5), and the ink tanks 46 are disposed inside the apparatus main body 20. The carriage 43 is supported by a guide shaft (not illustrated), and is configured to move in a direction intersecting the direction in which a medium M is transported. The recording head 41 and the ink tanks 46 are mounted on the carriage 43. The ink tanks 46 are disposed above the recording head 41 and house ink which is an example of a "liquid" supplied to the recording head 41.

Further, the recording head 41 is an example of a recording portion in the present application, and the ink tanks 46 are an example of a liquid housing portion in the present application. In addition, the direction intersecting the direction in which the medium M is transported is the X direction, and is hereinafter referred to as the scanning direction X. The scanning direction X is an example of a width direction that intersects the direction in which the medium is transported in the present application.

The recording head 41 has a common liquid chamber (not illustrated), a pressure generating chamber (not illustrated), a piezoelectric element (not illustrated), a nozzle (not illustrated), and the like, and ink is ejected onto the medium M supported by a medium supporting portion 44. The piezoelectric element is a bending vibration mode piezoelectric actuator or a longitudinal vibration mode piezoelectric actuator. In a state in which ink has been supplied to the pressure generating chamber, the piezoelectric element vibrates a vibration plate that forms a portion of the pressure generating chamber to generate a pressure fluctuation in the pressure generating chamber, and the recording head 41 ejects ink to the medium M by using the pressure fluctuation.

In the present embodiment, five ink tanks 46 are mounted on the carriage 43 and house four color inks. Specifically, two of the five ink tanks 46 house black (K) ink, and three of the five ink tanks 46 house any of cyan (C), magenta (M), and yellow (Y) inks. The ink of each color is supplied from the ink tanks 46 to the recording head 41.

Further, the number of ink tanks 46 mounted on the carriage 43 is not limited to five, and may be less than five or more than five. In addition, the number of ink colors housed in the ink tanks 46 is not limited to four colors, and may be more than four colors or less than four colors.

When ink is not to be ejected to the medium M, the carriage 43 is located at the home position as illustrated in FIG. 2. At the home position, a capping process for suppressing evaporation of the ink is performed on the recording head 41. In addition, at the home position, a maintenance process for restoring the recording head 41 to a normal state is performed on the recording head 41.

When checking the remaining amount of ink in the ink tanks 46 or when injecting ink into the ink tanks 46, the carriage 43 is disposed at the ink injection position as illustrated in FIG. 3.

In the present embodiment, when the user puts his hand on the handle portions 15 and opens the scanner unit 10 with respect to the casing 21, the carriage 43 is disposed at the ink injection position. Specifically, when the scanner unit 10 is changed from the closed state to the open state and a sensor 8 detects that the scanner unit 10 is in the open state, the control portion places the carriage 43 at the ink injection position. Then, the ink tanks 46 are exposed, and the ink can be poured into the ink tanks 46 from a refill container 48 (refer to FIG. 4). That is, when the scanner unit 10 is opened with respect to the casing 21 so as to expose the ink tanks 46, the control portion moves the ink tanks 46 to a position where ink can be injected from the refill container 48.

The recording apparatus 1 according to the embodiment has a configuration in which the scanner unit 10 is pivoted with respect to the casing 21 to expose the ink tanks 46 so that ink can be injected from the refill container 48 into the ink tanks 46.

Further, in order to make the state of the home position easy to understand, FIG. 2 illustrates a state in which the carriage 43 is disposed at the home position when the scanner unit 10 is in the open state. Actually, when the scanner unit 10 is in the open state, the carriage 43 is disposed at the ink injection position as illustrated in FIG. 3.

Of course, the carriage 43 can be disposed at the home position by operating the operation panel 18 when the scanner unit 10 is in the open state.

As illustrated in FIG. 3, when the carriage 43 is disposed at the ink injection position (when ink is to be injected from the refill container 48 into the ink tanks 46), an opening 45 that is long and that is provided in the carriage 43 in the X direction is disposed so as to overlap with the cutout 23 provided in the front-surface-side casing side wall portion 22 of the casing 21 in a plan view.

When the carriage 43 is disposed at the ink injection position (when ink is to be injected from the refill container 48 into the ink tanks 46), that is, when the scanner unit 10 is in the open state, the cutout 23 of the casing 21 and the opening 45 of the carriage 43 overlap in a plan view. Furthermore, the cutout 23 of the casing 21 and the opening 45 of the carriage 43 do not overlap with the panel unit 16 and the end portion 14 of the scanner unit 10 in a plan view. As a result, the user can view the ink tanks 46 from the direction from the front-surface-side casing side wall portion 22 to the pivot shaft 11 (Y direction).

Thus, when the scanner unit 10 and the panel unit 16 are open with respect to the casing 21, the cutout 23 of the casing 21 and the opening 45 of the carriage 43 overlap with the ink tanks 46 in a plan view, and the user can check the remaining amount of the ink housed in the ink tanks 46 via the cutout 23 and the opening 45.

With this configuration, when the carriage 43 is disposed at the ink injection position, the user can view and check the remaining amount of the ink housed in the ink tanks 46 via the cutout 23 of the casing 21 and the opening 45 of the carriage 43.

Further, the cutout 23 of the casing 21 and the opening 45 of the carriage 43 are examples of the viewing portion in the present application. That is, the casing 21 has the cutout 23 as a viewing portion that allows the user to view the remaining amount of ink housed in the ink tanks 46, and the carriage 43 has the opening 45 as a viewing portion that allows the user to view the remaining amount of ink housed in the ink tanks 46.

Each of the ink tanks 46 has a main body 46*a* in which ink is housed, an injection port 46*b* into which ink can be injected from the refill container 48, and a cap member 46*c*. The cap member 46*c* has one end as a pivot shaft and the other end is configured to pivot with respect to the main body 46*a*. The cap member 46*c* seals the injection port 46*b* and suppresses drying of the ink housed in the main body 46*a*. The main body 46*a* is formed of a translucent or transparent material, and the ink housed in the main body 46*a* can be checked from the outside. Furthermore, the main body 46*a* is provided with a scale (not illustrated) such as a scale for notifying that the ink is empty or a scale for notifying that the ink is full.

When the carriage 43 is located at the ink injection position, the user can view the ink tanks 46 and properly grasp the remaining amount of ink in each of the ink tanks 46 by the scale provided on the main body 46*a*.

When the carriage 43 is disposed at the ink injection position, that is, when the ink is to be injected from the refill container 48 into each of the ink tanks 46, the injection port 46*b* is disposed on the front-surface-side casing side wall portion 22 side with respect to the end portion 14 of the scanner unit 10. That is, when the ink is to be injected from the refill container 48 into each of the ink tanks 46, the injection port 46*b* is disposed outside the scanner unit 10.

As a result, as illustrated in FIG. 4, when the carriage 43 is disposed at the ink injection position, the refill container 48 is inserted into the injection port 46*b* of each of the ink tanks 46, and the ink can be injected from the refill container 48 into the ink tanks 46.

Thus, in the present embodiment, when the scanner unit 10 is in the open state, the ink tanks 46 are moved to the ink injection position, and the user checks the remaining amount of the ink housed in the ink tanks 46, and replenishes the ink tanks 46 with the ink from the refill container 48 when the remaining amount of the ink stored in the ink tanks 46 is low.

As illustrated in FIG. 5, a cassette 37 that houses a plurality of media M is disposed in a lower portion of the apparatus main body 20. The cassette 37 is disposed so as to be freely inserted into and removed from the casing 21.

Furthermore, a transport portion 30 that transports the medium M and a recording portion 40 that ejects ink to the medium M transported by the transport portion 30 in order to perform recording are disposed in the apparatus main body 20.

In the transport portion 30, a pickup roller 31, a reversing roller 33, and a transport roller pair 34 are sequentially disposed along the direction in which the medium M is transported.

The recording portion 40 has the carriage 43, which is configured to move in the scanning direction X, the recording head 41 and the ink tanks 46 (refer to FIG. 2) mounted on the carriage 43, and the medium supporting portion 44.

The pickup roller 31 is configured to rotate in a state of being in contact with the upper surface of the uppermost medium M among the plurality of media M housed in the cassette 37, and the medium M in the cassette 37 is sent out to the reversing roller 33, which has a large diameter. The transport direction of the medium M stored in the cassette 37 is reversed by the reversing roller 33, and the medium M is transported while being curved from above toward the front (toward the transport roller pair 34).

The transport roller pair 34 is disposed downstream of the reversing roller 33 in the transport direction of the medium M. The transport roller pair 34 transports the medium M in the transport direction by rotating a pair of upper and lower rollers sandwiching the medium M. Then, the medium M is transported by the transport roller pair 34 and reaches the medium supporting portion 44.

The medium supporting portion 44 is a rectangular member that is provided so as to face the recording head 41 and that is elongated in the scanning direction X. The medium supporting portion 44 has a smooth surface along a horizontal plane on a side facing the recording head 41. The medium M transported from the transport roller pair 34 is supported by the smooth surface of the medium supporting portion 44.

Then, in the recording apparatus 1 according to the present embodiment, an operation of ejecting ink onto the medium M while the recording head 41 moves in the scanning direction X, and an operation of transporting the medium M in a transport direction Y by the transport roller pair 34 are alternately repeated, thereby recording a desired image on the medium M.

Thus, the cutout 23, which is an example of the "viewing portion", is provided on the front-surface-side casing side wall portion 22 of the casing 21. The panel unit 16 is provided not on the front-surface-side casing side wall portion 22 of the casing 21 but on the scanner unit 10 and pivots together with the scanner unit 10. When the scanner unit 10 and the panel unit 16 are opened with respect to the casing 21, the front-surface-side casing side wall portion 22 of the casing 21, the carriage 43, and the ink tanks 46 are exposed, and the cutout 23 of the front-surface-side casing side wall portion 22, the opening 45 of the carriage 43, and the ink tanks 46 overlap in a plan view.

As a result, when the scanner unit 10 and the panel unit 16 are opened with respect to the casing 21, the user can check the remaining amount of ink in the ink tanks 46 and inject ink into the ink tanks 46.

Since the panel unit 16 and the cutout 23 and the opening 45, which are examples of the "viewing portion", are provided not in the same component but in different components, the size of the cutout 23 and the opening 45, which are examples of the "viewing portion", does not affect the size of the operation panel 18 of the panel unit 16, for example, even if the cutout 23 and the opening 45, which are examples of the "viewing portion", are increased in size, the operation panel 18 of the panel unit 16 does not become relatively small.

As a result, in order to properly check the remaining amount of ink in the ink tanks 46, the cutout 23 and the opening 45, which are examples of the "viewing portion", are increased in size, and, in addition, the size of the operation panel 18 of the panel unit 16 can be increased for easy operation. Therefore, user convenience is improved as compared with the case where any one of the cutout 23 and the opening 45, which are examples of the "viewing portion", and the operation panel 18 is increased in size.

Second Embodiment

Figure 7:
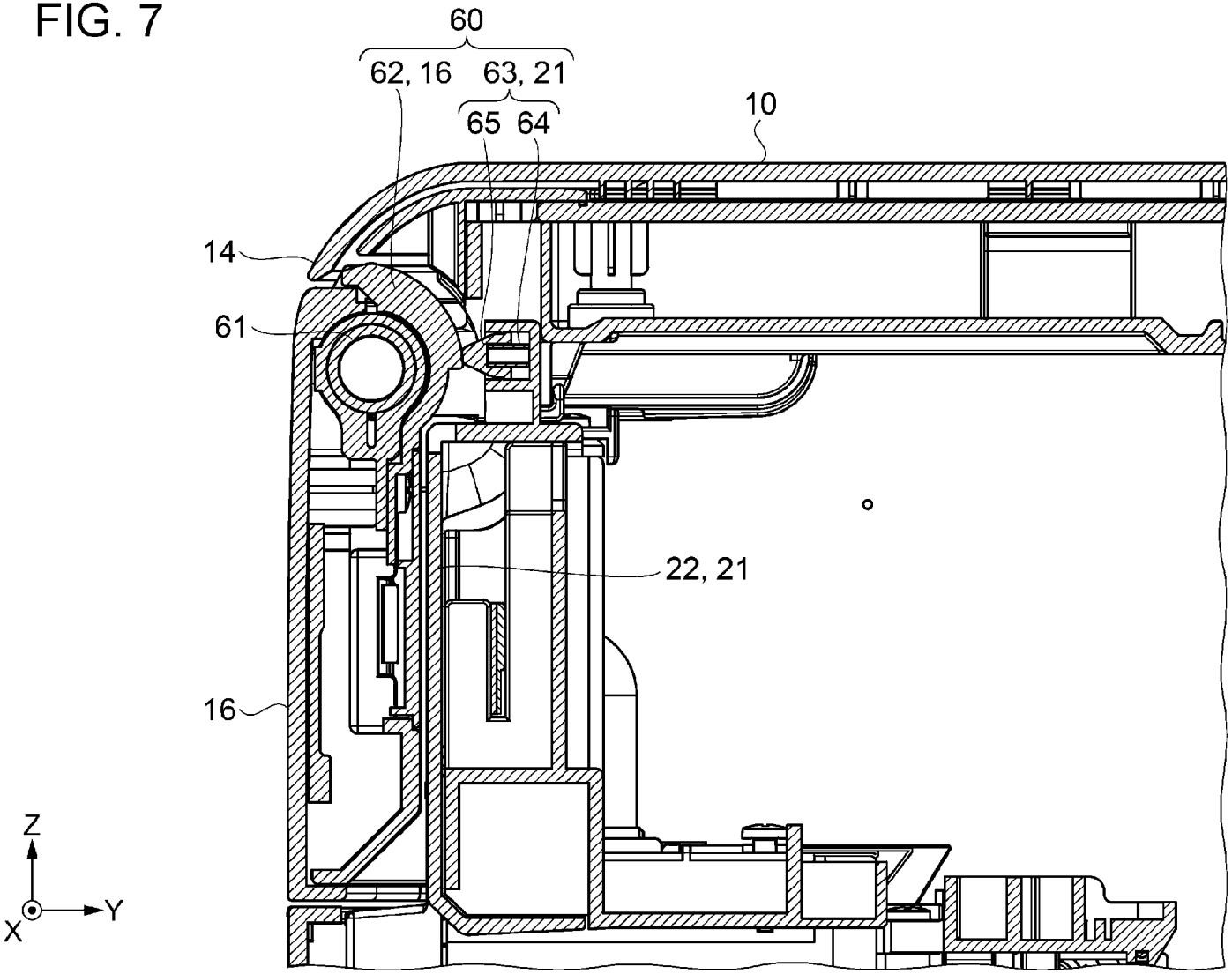
FIG. 7 is a sectional view of the main portion of the lock portion provided in a recording apparatus according to a second embodiment.
Figure 8:
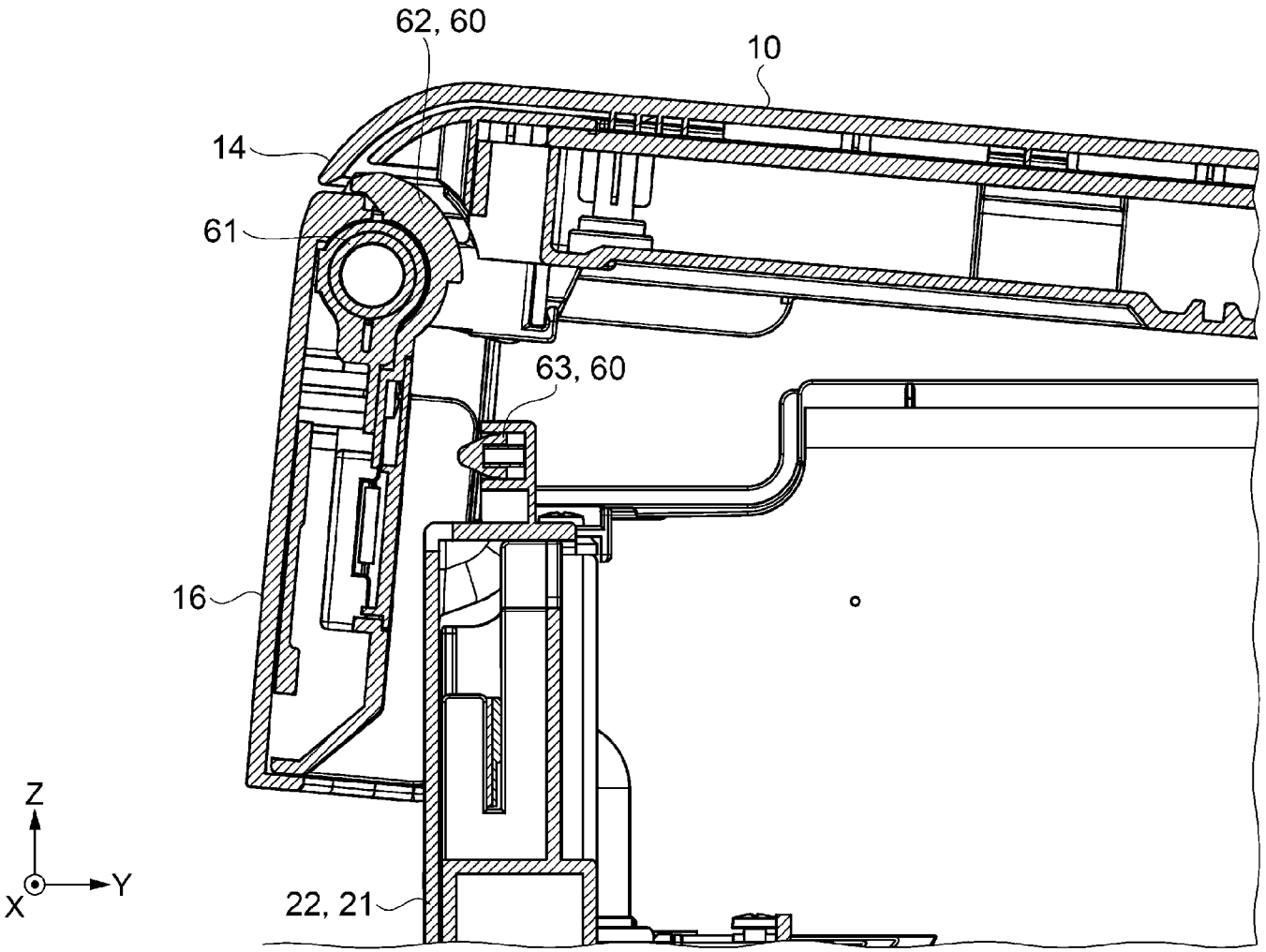
FIG. 8 is a sectional view of the main portion of the lock portion provided in the recording apparatus according to the second embodiment.
Figure 9:
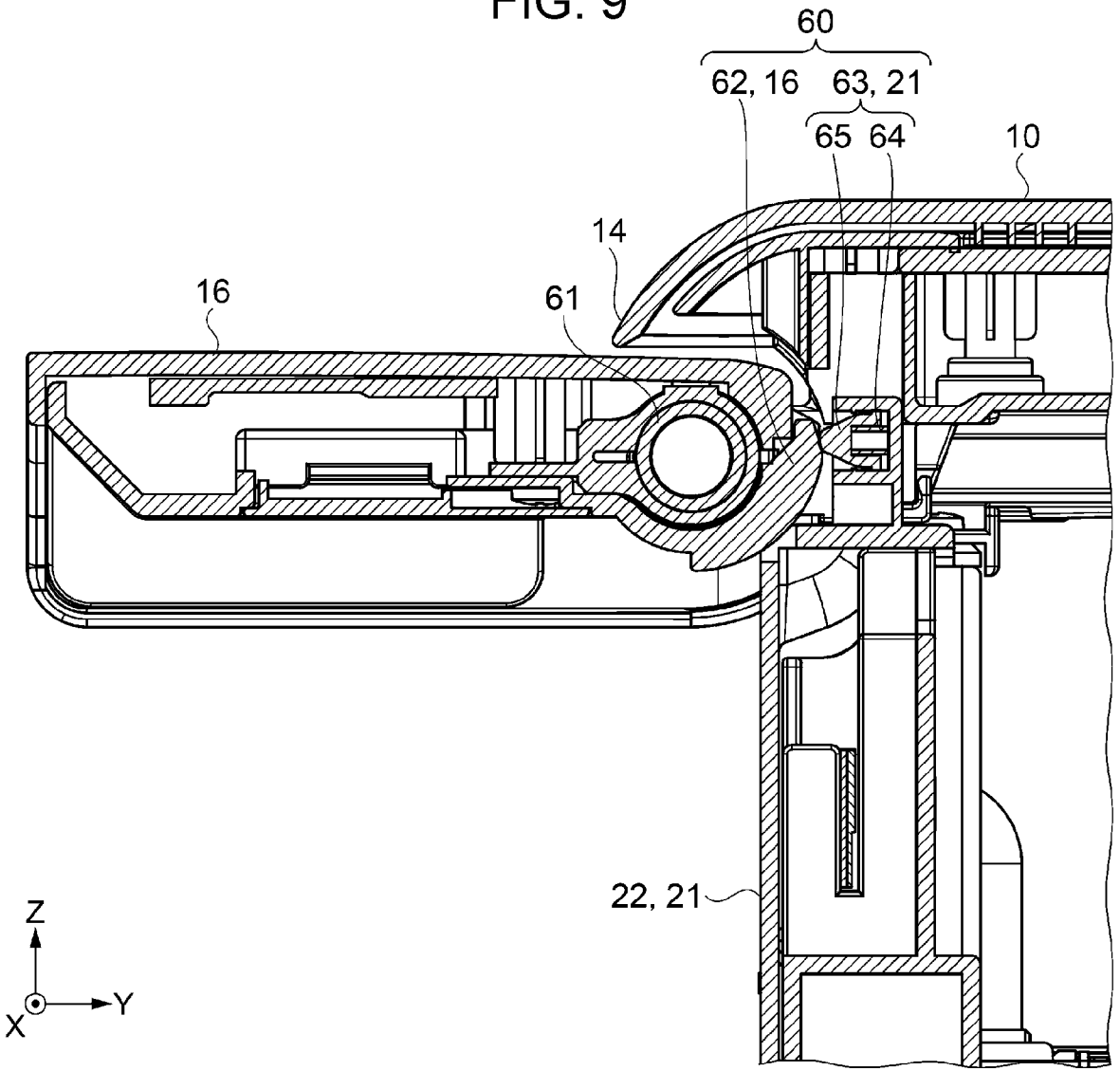
FIG. 9 is a sectional view of the main portion of the lock portion provided in the recording apparatus according to the second embodiment.
Figure 10:
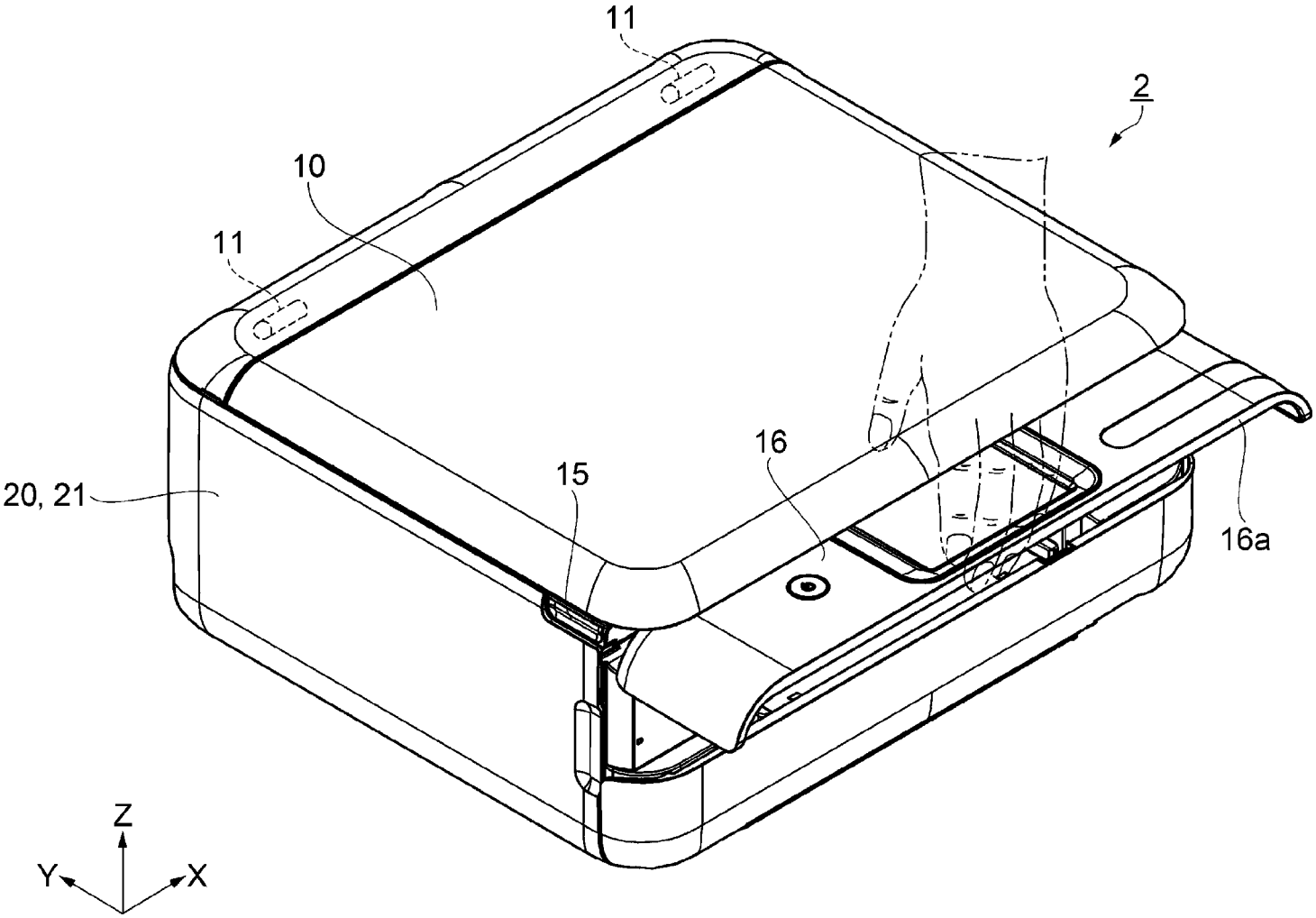
FIG. 10 is a perspective view of the recording apparatus according to the second embodiment.

FIGS. 7 to 9 are cross-sectional views of main portions of a lock portion 60 provided in a recording apparatus 2 according to the second embodiment. FIG. 10 is a perspective view of the recording apparatus 2 according to the present embodiment. FIG. 10 illustrates a state in which the panel unit 16 is opened with respect to the scanner unit 10.

The recording apparatus 2 according to the present embodiment is different from the recording apparatus 1 according to the first embodiment in terms of the configuration of the lock portion, and the other components are the same.

Hereinafter, an outline of the recording apparatus 2 according to the present embodiment will be described with reference to FIGS. 7 to 10, focusing on differences from the first embodiment. In addition, the same components as those in the first embodiment are denoted by the same reference signs, and redundant description will be omitted.

As illustrated in FIGS. 7 to 9, the panel unit 16 is attached to the end portion 14 of the scanner unit 10 and is configured to pivot with respect to the scanner unit 10 about a pivot shaft 61 as a pivot center.

The lock portion 60 included in the recording apparatus 2 according to the present embodiment includes a cam portion 62 provided on the panel unit 16 side and a pressing portion 63 provided on the casing 21 side. The cam portion 62 provided on the panel unit 16 side is fixed to the pivot shaft 61 and pivots together with the pivot shaft 61. The pressing portion 63 provided on the casing 21 side has a spring member 64 that can expand and contract, and a contact member 65 that can contact the cam portion 62. The contact member 65 is attached to a distal end of the spring member 64. The spring member 64 applies a force with which the contact member 65 presses the cam portion 62.

FIG. 7 illustrates the lock portion 60 when the panel unit 16 is in the closed state and the scanner unit 10 is in the closed state.

As illustrated in FIG. 7, when the scanner unit 10 is in the closed state, the spring member 64 is in a contracted state, and the spring member 64 in the contracted state applies a force to the contact member 65 so as to press the cam portion 62. That is, the pressing portion 63 presses the cam portion 62. Then, the scanner unit 10 is locked with respect to the casing 21, and the movement of the scanner unit 10 in the Z direction with respect to the casing 21 is restricted.

Thus, when the scanner unit 10 is in the closed state, the lock portion 60 locks the scanner unit 10 with respect to the casing 21.

FIG. 8 illustrates the lock portion 60 when the panel unit 16 is in the closed state and the scanner unit 10 is slightly opened with respect to the casing 21. Specifically, FIG. 8 illustrates a state in which the scanner unit 10 is opened approximately five degrees with respect to a horizontal plane.

As illustrated in FIG. 8, when the scanner unit 10 is opened with respect to the casing 21, the cam portion 62 and the pressing portion 63 are separated from each other, the state in which the pressing portion 63 presses the cam portion 62 is released, and the state in which the scanner unit 10 is locked with respect to the casing 21 is released. That is, when the scanner unit 10 is opened with respect to the casing 21, the force with which the pressing portion 63 presses the cam portion 62 is released, and the state in which the scanner unit 10 is locked with respect to the casing 21 is released.

Further, the force with which the pressing portion 63 presses the cam portion 62 corresponds to the force for releasing the state in which the scanner unit 10 is locked with respect to the casing 21, and this corresponds to a lock release load for releasing a locked state that restricts movement of the scanner unit in the present application.

That is, the force with which the pressing portion 63 presses the cam portion 62 corresponds to a lock release load for releasing a locked state that restricts the movement of the scanner unit 10, and may be hereinafter referred to as a lock release load.

FIG. 9 illustrates the lock portion 60 when the panel unit 16 is in the open state and the scanner unit 10 is in the closed state.

When the panel unit 16 illustrated in FIG. 9 is in the open state and when the panel unit 16 illustrated in FIG. 7 is in the closed state, the cam portion 62 is pivoted, the state of the cam portion 62 is different, and the position of the contact member 65 disposed in contact with the cam portion 62 in the Y direction is different. Then, when the contracted state of the spring member 64 is different and the panel unit 16 illustrated in FIG. 9 is in the open state, as compared with the case where the panel unit 16 illustrated in FIG. 7 is in the closed state, the spring member 64 is greatly contracted, and the force with which the pressing portion 63 provided by the spring member 64, which is greatly contracted, presses the cam portion 62 is increased.

As a result, when the panel unit 16 illustrated in FIG. 9 is in the open state, as compared with the case where the panel unit 16 illustrated in FIG. 7 is in the closed state, the pressing portion 63 strongly presses the cam portion 62, and the scanner unit 10 is strongly locked to the casing 21.

In the present embodiment, when the orientation of the panel unit 16 with respect to the casing 21 changes from the state illustrated in FIG. 7 to the state illustrated in FIG. 9, the cam portion 62 is provided so that the amount of contraction of the spring member 64 gradually increases. As a result, as illustrated in FIG. 9, when the panel unit 16 is maximally opened with respect to the casing 21, the amount of contraction of the spring member 64 is the largest, and the force with which the pressing portion 63 presses the cam portion 62 is the strongest. As illustrated in FIG. 7, when the panel unit 16 is closed with respect to the casing 21, the amount of contraction of the spring member 64 is the smallest, and the force with which the pressing portion 63 presses the cam portion 62 is the strongest.

Thus, the force (lock release load) with which the pressing portion 63 presses the cam portion 62 changes depending on the orientation of the panel unit 16 with respect to the casing 21, that is, the angle of the panel unit 16 with respect to the document table 12. That is, the present embodiment has a configuration in which the lock portion 60 changes the lock release load for releasing the locked state that restricts the movement of the scanner unit 10 in accordance with the angle of the panel unit 16 with respect to the document table 12.

Thus, when the panel unit 16 illustrated in FIG. 9 is in the open state, the scanner unit 10 is more strongly locked to the casing 21 than when the panel unit 16 illustrated in FIG. 7 is in the closed state.

Furthermore, although not illustrated, from the state in which the scanner unit 10 illustrated in FIG. 9 is closed with respect to the casing 21, when the scanner unit 10 is slightly opened with respect to the casing 21, the cam portion 62 and the pressing portion 63 are separated from each other, the state in which the pressing portion 63 presses the cam portion 62 is released, and the state in which the scanner unit 10 is locked with respect to the casing 21 is released.

When opening the scanner unit 10 under the condition that the panel unit 16 is in the closed state, the user puts his or her hands on the handle portions 15 and opens the scanner unit 10. In this case, the handle portions 15 serve as a point of application of the force, the pivot shaft 11 serves as a fulcrum, and the scanner unit 10 is opened with respect to the casing 21.

On the other hand, when the scanner unit 10 is opened under the condition that the panel unit 16 is in the open state, as illustrated in FIG. 10, the user can also open the scanner unit 10 by placing his or her hands on the distal end 16*a* of the panel unit 16. In this case, the distal end 16*a* of the panel unit 16 becomes a point of application of force, the pivot shaft 11 becomes a fulcrum, and the scanner unit 10 is opened with respect to the casing 21.

The distance between the point of action and the fulcrum becomes shorter when the panel unit 16 is in the closed state, and becomes longer when the panel unit 16 is in the open state. Therefore, according to the leverage principle, the user can open the scanner unit 10 with less force when the panel unit 16 is open than when the panel unit 16 is closed.

For this reason, under the condition that the panel unit 16 is in the open state and the condition that the panel unit 16 is in the closed state, the burden felt by the user during the same operation of opening the scanner unit 10 changes. However, if the user's sense of burden changes during the same operation of opening the scanner unit 10, the user may misunderstand that the state of the recording apparatus 1 has changed. For example, the user may misunderstand that the recording apparatus 1 has malfunctioned.

In the present embodiment, the lock release load changes such that when the scanner unit 10 is opened under the condition that the panel unit 16 is in the open state, the lock release load becomes stronger, and when the scanner unit 10 is opened under the condition that the panel unit 16 is in the closed state, the lock release load becomes weaker.

Then, the user can open the scanner unit 10 with the same burden when the panel unit 16 is in the open state and when the panel unit 16 is in the closed state. In the same operation of opening the scanner unit 10, the change in the sense of burden felt by the user is reduced, so that the above-mentioned possibility that the user misunderstands that the state of the recording apparatus 1 has changed is eliminated.

The contents derived from the embodiment will be described below.

A recording apparatus includes a recording portion that performs recording by ejecting a liquid onto a medium; a liquid housing portion that is disposed above the recording portion, that houses the liquid to be supplied to the recording portion, and that has an injection port through which the liquid is injected from a refill container, a carriage on which the recording portion and the liquid housing portion are mounted, and which is configured to move in a width direction intersecting a direction in which the medium is transported, a casing having the liquid housing portion therein, a scanner unit that is attached to the casing via a pivot shaft at an upper portion of the casing so as to pivot and that reads a document placed on a document table, and a panel unit through which various operations are performed, in which the panel unit is attached to an end portion of the scanner unit opposite to the pivot shaft and is configured to tilt between a first orientation and a second orientation closer to the document table than to the first orientation, and by pivoting the scanner unit with respect to the casing and opening the scanner unit by a fixed amount, the liquid is injected from the refill container into the liquid housing portion and a remaining amount of the liquid is viewed.

The recording apparatus includes a scanner unit attached to the casing so as to pivot, and a panel unit attached to the scanner unit (hereinafter, sometimes referred to as an operation panel), and the scanner unit and the operation panel are integrally pivoted to expose the liquid housing portion, to allow the remaining amount of the liquid stored in the liquid housing portion to be checked, and allow the liquid to be injected from the refill container into the liquid housing portion.

Because the scanner unit and the operation panel pivot integrally to expose the liquid housing portion, even if the operation panel is increased in size, the operation of checking the remaining amount of the liquid stored in the liquid housing portion is not hindered, and the operation of injecting the liquid from the refill container into the liquid housing portion is not hindered. For this reason, because the operation panel can be increased in size and the operation panel can be easily operated while making it easy to check the remaining amount of the liquid housed in the liquid housing portion and easy to inject the liquid from the refill container into the liquid housing portion, user convenience is improved.

In the recording apparatus, it is preferable that the carriage and the casing include a viewing portion that allows a user to view the remaining amount of the liquid housed in the liquid housing portion.

When a viewing portion is provided in the carriage and the casing so that the remaining amount of the liquid stored in the liquid housing portion can be viewed, the remaining amount of the liquid housed in the liquid housing portion can be confirmed from the outside of the apparatus, and user convenience is improved.

In the recording apparatus, it is preferable that the casing include a front-surface-side casing side wall portion that is disposed so as to face the panel unit in the first orientation, and the viewing portion be provided on the front-surface-side casing side wall portion.

When the viewing portion is provided on the front-surface-side casing side wall portion so that the remaining amount of the liquid housed in the liquid housing portion can be viewed, for example, when the panel unit is in the second position, the remaining amount of the liquid stored in the liquid housing portion can be confirmed from outside the device, and user convenience is improved.

In the recording apparatus, when the scanner unit is opened, in a plan view viewed from a direction toward the pivot shaft from the front-surface-side casing side wall portion, it is preferable that the viewing portion not overlap with the panel unit and the end portion.

When the scanner unit is opened, in a plan view viewed from a direction toward the pivot shaft from the front-surface-side casing side wall portion, if the viewing portion does not overlap the panel unit and the end portion, the liquid can be injected from the refill container into the liquid housing portion while checking the remaining amount of the liquid housed in the liquid housing portion.

In the recording apparatus, it is preferable that the injection port be disposed outside the scanner unit.

When injecting liquid from the refill container into the liquid housing portion, the injection port is located outside the end portion of the scanner unit. Thus, the liquid can be injected from the refill container into the liquid housing portion from the front-surface-side casing side wall portion.

In the recording apparatus, it is preferable that the panel unit be configured to be operated both in the case where the scanner unit is opened with respect to the casing so that the liquid is injected from the refill container into the liquid housing portion and in the case where the scanner unit is closed with respect to the casing to cover the liquid housing portion.

When the panel unit is configured to be operated both in the case where the scanner unit is opened with respect to the casing and in the case where the scanner unit is closed with respect to the casing, user convenience is improved compared to when the panel unit is configured to be operated only in the case where the scanner unit is opened with respect to the casing or only in the case where the scanner unit is closed with respect to the casing.

It is preferable that the recording apparatus further include a lock portion that restricts movement of the scanner unit in a state in which the scanner unit is closed with respect to the casing so as to cover the liquid housing portion.

For example, even if an impact is applied to the scanner unit due to the movement of the recording apparatus or the like, because the movement of the scanner unit is restricted by the lock portion, the scanner unit is less likely to be mechanically damaged.

In the recording apparatus, it is preferable that the lock portion change a lock release load that releases a locked state that restricts movement of the scanner unit in accordance with an angle of the panel unit with respect to the document table.

If the lock release load can be changed, for example, the lock release load can be optimized and the locked state can be properly released.

In the recording apparatus, it is preferable that the panel unit, when viewed from the front in a closed state, overlap with the viewing portion.

When the panel unit overlaps with the viewing portion, the viewing portion is covered, and dirt and damage of the viewing portion can be prevented.

What is claimed is:

1. A recording apparatus comprising:

a recording portion that performs recording by ejecting a liquid onto a medium;

a liquid housing portion that is disposed above the recording portion, that houses the liquid to be supplied to the recording portion, and that has an injection port through which the liquid is injected from a refill container;

a carriage on which the recording portion and the liquid housing portion are mounted, and which is configured to move in a width direction intersecting a direction in which the medium is transported;

a casing having the carriage therein, a scanner unit that is attached to the casing via a pivot shaft at an upper portion of the casing so as to pivot and that reads a document placed on a document table, and a panel unit through which various operations are performed, wherein the panel unit is attached to an end portion of the scanner unit opposite to the pivot shaft and is configured to tilt between a first orientation and a second orientation closer to the document table than to the first orientation, and by pivoting the scanner unit, with the panel unit attached, with respect to the casing and opening the scanner unit by a fixed amount, the liquid is injected from the refill container into the liquid housing portion and a viewing portion formed through a side wall is exposed to allow a remaining amount of the liquid to be viewed.

2. The recording apparatus according to claim 1, wherein the carriage and the casing include the viewing portion that allows a user to view the remaining amount of the liquid housed in the liquid housing portion.

3. The recording apparatus according to claim 2, wherein the casing includes a front-surface-side casing side wall portion that is disposed so as to face the panel unit in the first orientation, and the viewing portion is provided on the front-surface-side casing side wall portion.

4. The recording apparatus according to claim 3, wherein, when the scanner unit is opened, in a plan view viewed from a direction toward the pivot shaft from the front-surface-side casing side wall portion, the viewing portion does not overlap with the panel unit and the end portion.

5. The recording apparatus according to claim 4, wherein the injection port is disposed outside the scanner unit.

6. The recording apparatus according to claim 1, wherein, the panel unit is configured to be operated both in the case where the scanner unit is opened with respect to the casing so that the liquid is injected from the refill container into the liquid housing portion and in the case where the scanner unit is closed with respect to the casing to cover the liquid housing portion.

7. The recording apparatus according to claim 1, further comprising:

a lock portion that restricts movement of the scanner unit in a state in which the scanner unit is closed with respect to the casing so as to cover the liquid housing portion.

8. The recording apparatus according to claim 7, wherein the lock portion changes a lock release load that releases a locked state that restricts movement of the scanner unit in accordance with an angle of the panel unit with respect to the document table.

9. The recording apparatus according to claim 1, wherein the panel unit, when viewed from the front in a closed state, overlaps the viewing portion.

10. A recording apparatus comprising:

a recording portion that performs recording by ejecting a liquid onto a medium;

a liquid housing portion that is disposed above the recording portion, that houses the liquid to be supplied to the recording portion, and that has an injection port through which the liquid is injected from a refill container;

a carriage on which the recording portion and the liquid housing portion are mounted, and which is configured to move in a width direction intersecting a direction in which the medium is transported;

a casing having the carriage therein, a scanner unit that is attached to the casing via a pivot shaft at an upper portion of the casing so as to pivot and that reads a document placed on a document table, and a panel unit through which various operations are performed, a lock portion that restricts movement of the scanner unit in a state in which the scanner unit is closed with respect to the casing so as to cover the liquid housing portion, the lock portion changes a lock release load that releases a locked state that restricts movement of the scanner unit in accordance with an angle of the panel unit with respect to the document table, wherein the panel unit is attached to an end portion of the scanner unit opposite to the pivot shaft and is configured to tilt between a first orientation and a second orientation closer to the document table than to the first orientation, and by pivoting the scanner unit with respect to the casing and opening the scanner unit by a fixed amount, the liquid is injected from the refill container into the liquid housing portion and a remaining amount of the liquid is viewed.

* * * * *